US007392010B2

(12) United States Patent
Shibuya

(10) Patent No.: US 7,392,010 B2
(45) Date of Patent: Jun. 24, 2008

(54) IMAGE FORMING APPARATUS WITH PREHEATING MODE OPERATING BEFORE IMAGE FORMATION

(75) Inventor: Kenichi Shibuya, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 11/411,070

(22) Filed: Apr. 26, 2006

(65) Prior Publication Data

US 2006/0245801 A1 Nov. 2, 2006

(30) Foreign Application Priority Data

May 2, 2005 (JP) ..... 2005-134116

(51) Int. Cl.
*G03G 15/00* (2006.01)
*G03G 15/20* (2006.01)

(52) U.S. Cl. ..... 399/390; 399/67; 399/333

(58) Field of Classification Search ..... 399/45, 399/67, 68, 333, 389, 390
See application file for complete search history.

(56) References Cited

U.S. PATENT DOCUMENTS

RE35,923 E * 10/1998 Mitsuya ..... 399/67 X
5,974,298 A * 10/1999 Urban et al. ..... 399/390 X
6,996,361 B2 * 2/2006 Ichida et al. ..... 399/390 X
7,087,305 B2 * 8/2006 Chen et al. ..... 399/333 X
2004/0120739 A1 * 6/2004 Chen et al. ..... 399/329
2005/0008379 A1 * 1/2005 Omata ..... 399/45

FOREIGN PATENT DOCUMENTS

| | | |
|---|---|---|
| JP | 5-281874 | 10/1993 |
| JP | 2000-314618 | 11/2000 |
| JP | 2001-318548 | * 11/2001 |
| JP | 2002-268469 | 9/2002 |
| JP | 2002-311793 | 10/2002 |
| JP | 2002-365934 | 12/2002 |
| JP | 2003-131445 | 5/2003 |

* cited by examiner

*Primary Examiner*—Sandra L Brase
(74) *Attorney, Agent, or Firm*—Fitzpatrick, Cella, Harper & Scinto

(57) ABSTRACT

An image forming apparatus having an image forming device for forming an image on a recording material, a fixing member for fixing the image formed on the recording material in a fixing nip, and a pressure member brought into pressure contact with the fixing member to form the fixing nip, the hardness of the pressure member being smaller than the hardness of the fixing member, wherein the image forming apparatus is operable in a mode for inserting the recording material into the fixing nip so that the image forming surface of the recording material is brought into contact with the pressure member, and subjecting the recording material to a preheating process, and then forming the image.

6 Claims, 13 Drawing Sheets

FIG. 10

| | FREQUENCY OF PREHEATING | | | |
|---|---|---|---|---|
| Rmax(μm) | ZERO TIME | ONCE | TWICE | THREE TIMES |
| 100 | × | ○ | ○ | ○ |
| 150 | × | × | ○ | ○ |
| 200 | × | × | × | ○ |

FIG. 11

| | TIME FOR PRE-MULTI-ROTATION [SECONDS] | | | |
|---|---|---|---|---|
| Rmax(μm) | 0 (ONLY PRE-ROTATION) | 10 | 20 | 30 |
| 100 | ○ | ○ | ○ | ○ |
| 125 | × | ○ | ○ | ○ |
| 150 | × | × | ○ | ○ |
| 175 | × | × | × | ○ |

FIG. 12

| | TIME FOR PRE-MULTI-ROTATION [SECONDS] | | | |
|---|---|---|---|---|
| Rmax(μm) | 0 (ONLY PRE-ROTATION) | 7 | 15 | 23 |
| 100 | ○ | ○ | ○ | ○ |
| 125 | × | ○ | ○ | ○ |
| 150 | × | × | ○ | ○ |
| 175 | × | × | × | ○ |

IMAGE FORMING APPARATUS WITH PREHEATING MODE OPERATING BEFORE IMAGE FORMATION

BACKGROUND OF THE INVENTION

1. Field of the Invention

The invention relates to an image forming apparatus using an electrophotographic printing method or an electrostatic recording method, and particularly to an image forming apparatus such as a copying machine, a printer or a facsimile apparatus.

2. Description of the Related Art

An example of a conventional image forming apparatus will hereinafter be described with reference to FIGS. 8 and 9 of the accompanying drawings.

As shown in FIG. 8, a copying machine 801 as an image forming apparatus applies a laser beam to the surface of an image bearing member 803 uniformly charged by a charging device 802, in accordance with image information to form an electrostatic latent image.

The electrostatic latent image is developed into a toner image by a developing apparatus 804, whereafter the toner image on the image bearing member 803 is transferred onto a recording material S by a transfer device 805. The unfixed toner image on the recording material S in this state is heated and pressure-fixed by a fixing device 806 to obtain a fixed image.

The fixing device 806, as shown in FIG. 9, has a fixing roller 808 provided with a halogen heater 807 therein, a pressure roller 809 disposed in opposed relationship with the fixing roller 808, a cleaning web 810 for cleaning the fixing roller 808, etc.

The fixing roller 808 comprises of a hollow mandrel of aluminum having a thickness of 12 mm and a silicon rubber layer of the order of 100 μm as an intermediate layer provided thereon, and covered with fluorine resin such as PTFE (polytetrafluoroethylene) of the order of 20 μm so as to form a surface layer.

The pressure roller 809 comprises a mandrel of stainless steel and a silicone rubber layer having a thickness of 5 mm provided thereon, and covered with a tube of PFA (tetrafluoroethylene perfluoroalkylvinyl ether copolymer resin) of the order of 100 μm so as to form a surface layer.

The temperature of the fixing roller 808 is controlled so as to be maintained at 200 degrees by a control device 812. The unfixed toner 813 on the recording material S is fixed in the fixing area (fixing nip) between the fixing roller 808 and the pressure roller 809, and is permanently fixed on the recording material S.

The fixing roller 808 provided with the heater therein as described above adopts a silicone rubber layer having a small thickness in order to efficiently receive heat from the halogen heater 807 in the interior of the mandrel, and suppress the inconvenience that the silicone rubber layer is stripped off from the mandrel. Also, the pressure roller 809 adopts a silicone rubber layer thicker than that of the fixing roller 808 in order to increase the area per unit time in which the recording material S passes through the fixing nip. Further, the rubber layer of the fixing roller can be made thin to thereby shorten the time required to raise the temperature of the fixing roller to a fixing temperature, i.e., the so-called warmup time.

The outer diameter of each of the fixing roller 808 and the pressure roller 809 is 60 mm. The cleaning web 810 is formed of nonwoven fabric of polyamide or the like, and is impregnated with silicone oil. The cleaning web 810 is brought into contact with the surface of the fixing roller 808, and is taken up in a direction opposite to the direction of the rotation of the fixing roller 808 at a speed of 0.05 mm/s only during image formation to thereby remove the toner offset on the fixing roller 808.

A thermistor 811 for detecting the temperature of the fixing roller 808 is brought into contact with an area of the surface of the fixing roller 808 which the recording material S passes. The output of the halogen heater 807 is controlled on the basis of the temperature detected by the thermistor 811.

The maximum output of the halogen heater 807 during image formation is 1500 W, and can heat and fix 60 sheets of recording materials S of e.g. A3 size per minute. The rotating speed of the fixing roller 808 is controlled to 500 mm/s.

However, in such a fixing device as shown in FIG. 9, when embossed paper having a high demand for the printing of a note of invitation, an invitation card, a catalog, a pamphlet, etc. is passed, there is a case where the rubber layer of the fixing roller does not follow the irregularities of the surface due to embossing. In that case, the surface of the fixing roller becomes incapable of directly contacting with and heating the surfaces of the concave groove portions of the embossed paper, and thus, the fixability of the toner transferred to the groove portions is reduced.

As the result, there arise a problem such as an image fault due to a reduction in the density of the groove portions, and the problem that the toner which cannot be completely fixed is offset on the fixing roller in a great deal, and cannot be completely remove by the cleaning web to thereby contaminate the next recording material or contaminate the fixing device itself.

SUMMARY OF THE INVENTION

It is an object of the present invention to provide an image forming apparatus which can well fix a toner image on a recording material having a great degrees of irregularities on the image forming surface thereof.

It is also an object of the present invention to provide an image forming apparatus comprising image forming means for forming an image on a recording material, a fixing member for fixing the image formed on the recording material in a fixing nip, and a pressure member brought into pressure contact with the fixing member to form the fixing nip, the hardness of the pressure member being smaller than the hardness of the fixing member, wherein the apparatus is operable in a mode for preheating the recording material by inserting the recording material into the fixing nip so that the image forming surface of the recording material is brought into contact with the pressure member, before image formation.

It is also an object of the present invention to provide, in an image forming apparatus having image forming means for forming an image on a recording material, a fixing member for fixing the image formed on the recording material in a fixing nip, and a pressure member brought into pressure contact therewith, an image forming method of forming an image on a recording material having its image forming surface subjected to embossing, comprising a first step of preheating the recording material by inserting the recording material into the fixing nip so that the image forming surface in brought into contact with the pressure member smaller in hardness than the fixing member, a second step of reversing the front and back sides of the recording material and conveying the recording material toward the image forming means, a third step of forming an image on the image forming surface of the recording material, and a fourth step of inserting the recording material into the fixing nip so that the image forming surface is brought into contact with the fixing member to fix the image.

Further objects of the present invention will become apparent from the following detailed description when read with reference to the accompanying drawings.

BRIEF DESCRIPTION OF THE DRAWINGS

FIG. 10 is a table showing the relation between the maximum surface roughness Rmax of embossed paper and the fixability by the frequency of preheating.

FIG. 11 is a table showing the relation between the time for pre-multi-rotation relative to embossed paper of which Rmax is 100 μm, 125 μm, 150 μm or 175 μm and fixability.

FIG. 12 is a table showing the relation between the time for pre-multi-rotation relative to embossed paper of which Rmax is 100 μm, 125 μm, 150 μm or 175 μm and fixability.

DESCRIPTION OF THE PREFERRED EMBODIMENTS

The best form for carrying out this invention will hereinafter be described in detail by way of example with reference to the drawings and embodiments. However, the dimensions, materials, shapes and relative arrangement of constituent parts described in these embodiments are not intended to restrict the scope of this invention thereto, unless particularly described. Also, the materials, shapes, etc. of members once described in the following description are similar to those first described, unless particularly newly described.

Embossed paper will first be described as an example of a recording material having irregularities on the surface thereof of which the fixability can be improved by the present invention.

Figure 1:
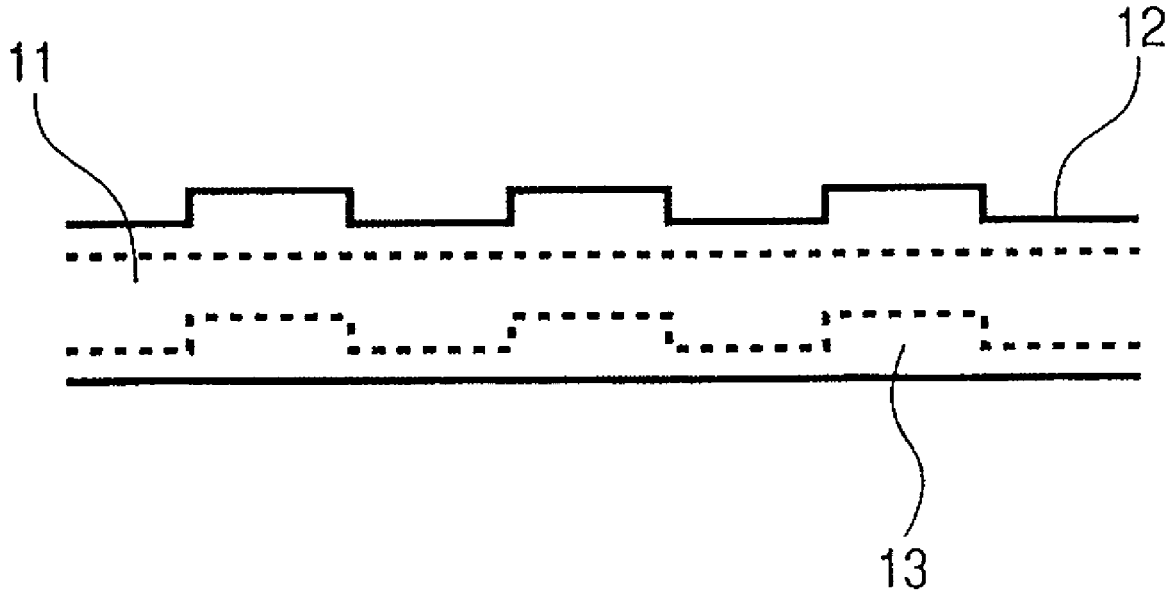
FIG. 1 is a schematic view showing the layer construction of embossed paper for use in an electrophotographic image forming apparatus which can be suitably used in the present invention.

FIG. 1 is a schematic view showing the layer construction of embossed paper for use in an electrophotographic image forming apparatus. The reference numeral 11 designates the base material of a recording material which is plain paper of medium quality or fine quality. The basis weight thereof may preferably be 30 to 300 g/m$^2$, and more preferably be 45 to 250 g/m$^2$.

The reference numeral 12 denotes a layer indicating embossing work. In this case, as a method of imparting embossing work, there is a method of passing base paper through the nip between a metal roll having a sculptural pattern such as, for example, a satin finished surface, a blanket texture pattern or a reticulation and an elastic roll to thereby emboss the base paper. There is also a method of imparting various irregular patterns, such as a method of using felt having a woven design peculiar to felt used in the drying step of a paper machine, and imparting the felt design to wet base paper having advanced from a wire part to a dry part. A paste material is usually used to make the irregularities clear. The paste material is not particularly specified, but use may preferably be of synthetic paste rather than starch paste, and particularly paste which is water-soluble and becomes non-water-soluble when solidified.

Specifically, mention may be made of polyolefin resin such as polyethylene or polypropylene, resin of vinyl origin such as polyester resin, resin of polyether origin, synthetic resin of polyamide origin, polystyrene, polyacrylic (polymethacrylic) ester, polyacrylonitrile, polyvinyl acetate or polyvinyl alcohol, resin of cellulose origin, other many simple substances of resin, a solution of a copolymer, resin solution of water origin such as emulsion or dispersion, and resin emulsion of water origin.

The reference numeral 13 designates a layer on the opposite side which is usually subjected to a smoothing process with a paper passing and conveying property taken into account. In terms of Bekk smoothness (JTAPPI. No. 5B method), the time for the process may preferably be 15 seconds or longer and less than 40 seconds.

While embossed paper will hereinafter be described as an example of the recording material having irregularities, the recording material which can be improved in fixability by the present invention is not restricted thereto.

In the present example, as an index representing the degree of irregularities formed on the image forming surface of the recording material, use is made of M (μm$^2$) which is a parameter obtained by multiplying a maximum height Rmax (μm) by a mean spacing Sm (μm) between peaks. This parameters M is a parameter substantially conforming to the area of a concave portion, and provides an index corresponding to the difficulty of fixing of the toner image formed in such concave portion as described above. So, in the present example, the present construction can be suitably applied to a recording material provided with an image forming surface in which the value of this M is $15\times10^3$ (μm$^2$) or greater. Both of the maximum height Rmax (μm) and the mean spacing S (μm) between peaks are values based upon JIS B 0601.

Comparative Examples

Figure 2A:
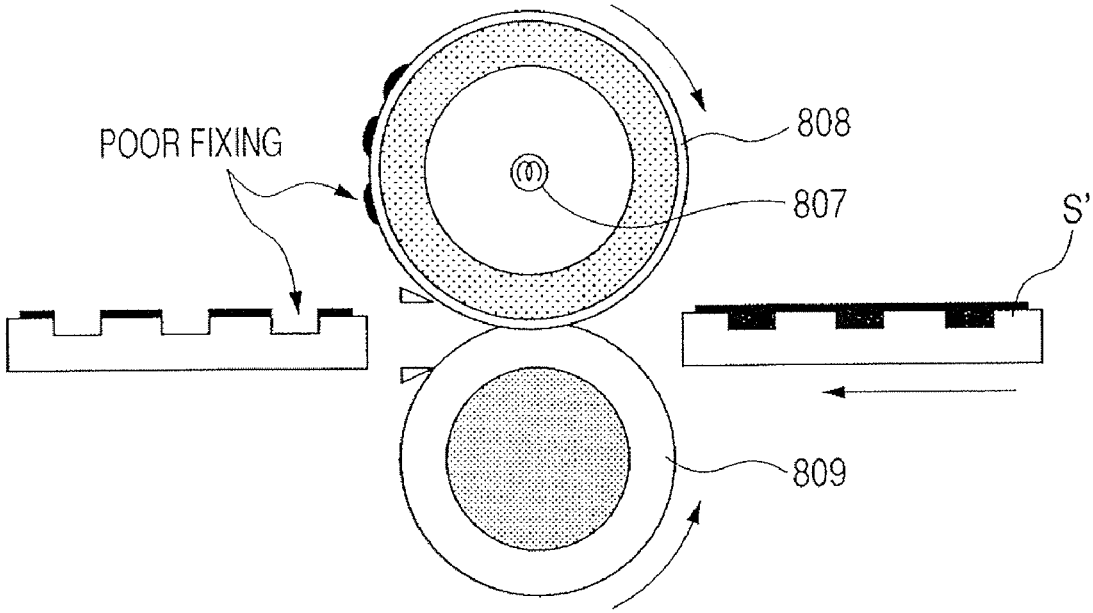
FIG. 2A PRIOR ART
FIGS. 2A and 2B are illustrations when a recording material subjected to embossing has been passed through a conventional fixing device.

FIG. 2A is a typical view showing a state in which in a conventional fixing device, a recording material having a toner transferred to the embossed surface thereof has been passed through the fixing device. Heat is transmitted to the toner transferred to the smooth surface (convex portions) of the recording material, whereby the toner is fixed on the recording material. On the other hand, poor fixing (such as, for example, toner offset to the fixing roller or the stripping-off of the toner from the recording material) occurs to the toner in the embossed groove portions (concave portions), and the fixing device and the interior of the image forming apparatus are contaminated.

Figure 2B:
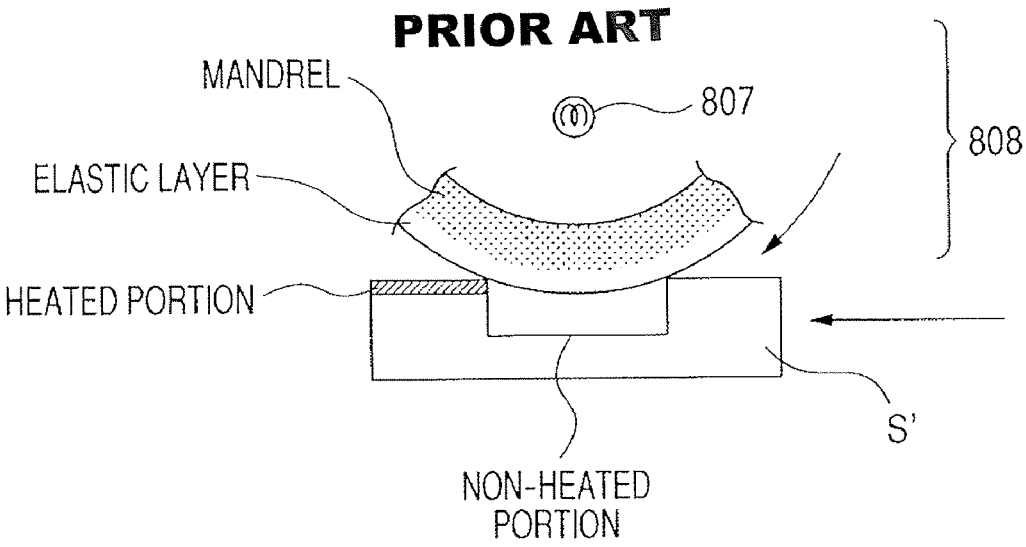
FIG. 2B PRIOR ART

So, as the result of my assiduous researches, it has been found that as shown in FIG. 2B, the surface of the fixing roller 808 does not follow the concave portions of the irregularities and does not directly or proximately sufficiently transmit heat to the walls of the concave portions of the recording material, whereby the thermal fusion of the toner and the walls of the concave portions of the embossed surface is weak to thereby cause poor fixing.

Also, as the elastic layer of the conventional fixing roller, a silicone rubber layer of 100 μm is installed on the mandrel, but a number of concave portions having a depth of 100 μm exist on embossed paper usually used in printing, and it is considered that only the concave portions were remarkably aggravated in fixability.

Here is conceivable a method of making the elastic layer of the fixing roller thicker to improve the follow-up property of the concave portions. However, when the elastic layer is made thicker, the thermal response property from the halogen heater is correspondingly aggravated. Therefore, the fixability during the continuous passing of plain paper under a low-temperature environment or the like is aggravated. Also, correspondingly to the elastic layer having been made thicker in order to keep the surface temperature of the fixing roller constant, it is necessary to set the temperature of the internal halogen heater high, and energy efficiency is reduced and the temperature of the adhesively secured surface between the mandrel and the elastic layer suddenly rises and the elastic layer becomes liable to be stripped off from the mandrel.

Such a construction of the fixing device as will be described below is adopted in each embodiment which will be described later.

This fixing device has a fixing roller having a halogen heater provided therein, a pressure roller disposed in opposed relationship with the fixing roller, a cleaning web for cleaning the fixing roller, etc.

The fixing roller as a fixing member comprises a hollow mandrel of aluminum having a thickness of 12 mm, and a silicone rubber layer of 100 μm as in intermediate layer provided thereon, and covered with fluorine resin of PTFE (polytetrafluoroethylene) of 20 μm so as to form a surface layer.

The pressure roller as a pressure member comprises of a mandrel of stainless steel and a silicone rubber layer having a thickness of 5 mm provided thereon, and covered with a tube of 100 μm formed of PFA (tetrafluoroethylene perfluoroalkyl vinyl ether copolymer resin) so as to form a surface layer.

The temperature of the fixing roller is controlled so as to be maintained at 200 degrees. The unfixed toner on the recording material S is fused in the fixing area (fixing nip) between the fixing roller and the pressure roller, and is permanently fixed on the recording material S.

The silicone rubber layer of the fixing roller is made thinner than the rubber layer of the pressure roller in order to shorten the raising time (warmup time) from the standby time and enhance the responsiveness of heat from the halogen heater. That is, the hardness of the fixing roller is made greater than the hardness of the pressure roller. In other words, the pressure roller is made greater in the deformation amount in the fixing nip than the fixing roller.

It is desirable for the rubber layer of the fixing roller to have a thickness of 10 to 200 μm, and it is desirable for the rubber layer of the pressure roller to have a thickness of 1 to 10 mm in order to widen the fixing nip and enhance the fixability. As the construction of the fixing roller, there may be adopted a construction in which a rubber layer is not provided on the mandrel, but only a toner releasing layer (a layer containing fluorine resin) is provided on the mandrel. It should be noted that the hardness of the fixing roller or the pressure roller is not the hardness of the rubber singly, but the hardness obtained by measuring a roller having a rubber layer and a surface layer formed on a mandrel by an Asker C hardness meter (JIS K 7312).

Embodiment 1

Figure 3A:
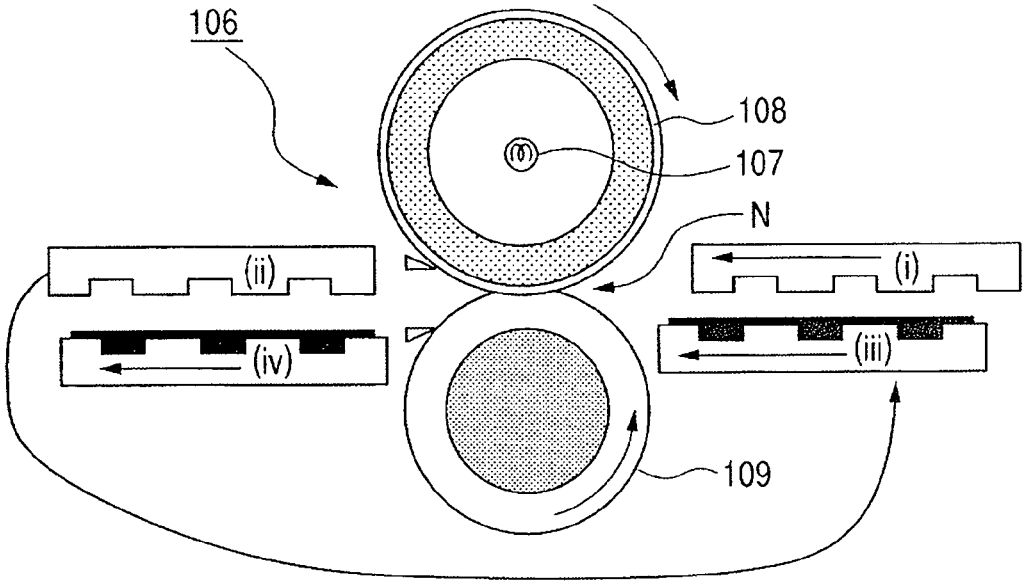
FIGS. 3A and 3B are typical views for illustrating a method of fixing embossed paper according to Embodiment 1.

So, in the present embodiment, there is provided means for contacting with or coming close to the concave portion of embossed paper to thereby give heat to the latter, without the construction of the fixing roller being changed. FIG. 3A is a typical view for illustrating a method of fixing the embossed paper according to Embodiment 1. In this fixing method, embossed paper S' which is a recording material is passed through the fixing nip N between a fixing roller 108 and a pressure roller 109 which are a plurality of rotary members opposed to each other to thereby fix a toner image formed on the image forming surface of the embossed paper S' having irregularities.

On the operating portion (e.g. the liquid crystal display portion) of an image forming apparatus, there is provided, for example, a mode designating portion (mode selecting button) for designating image formation on "embossed paper", together with other designating portion for density selection or the like.

Figure 13:
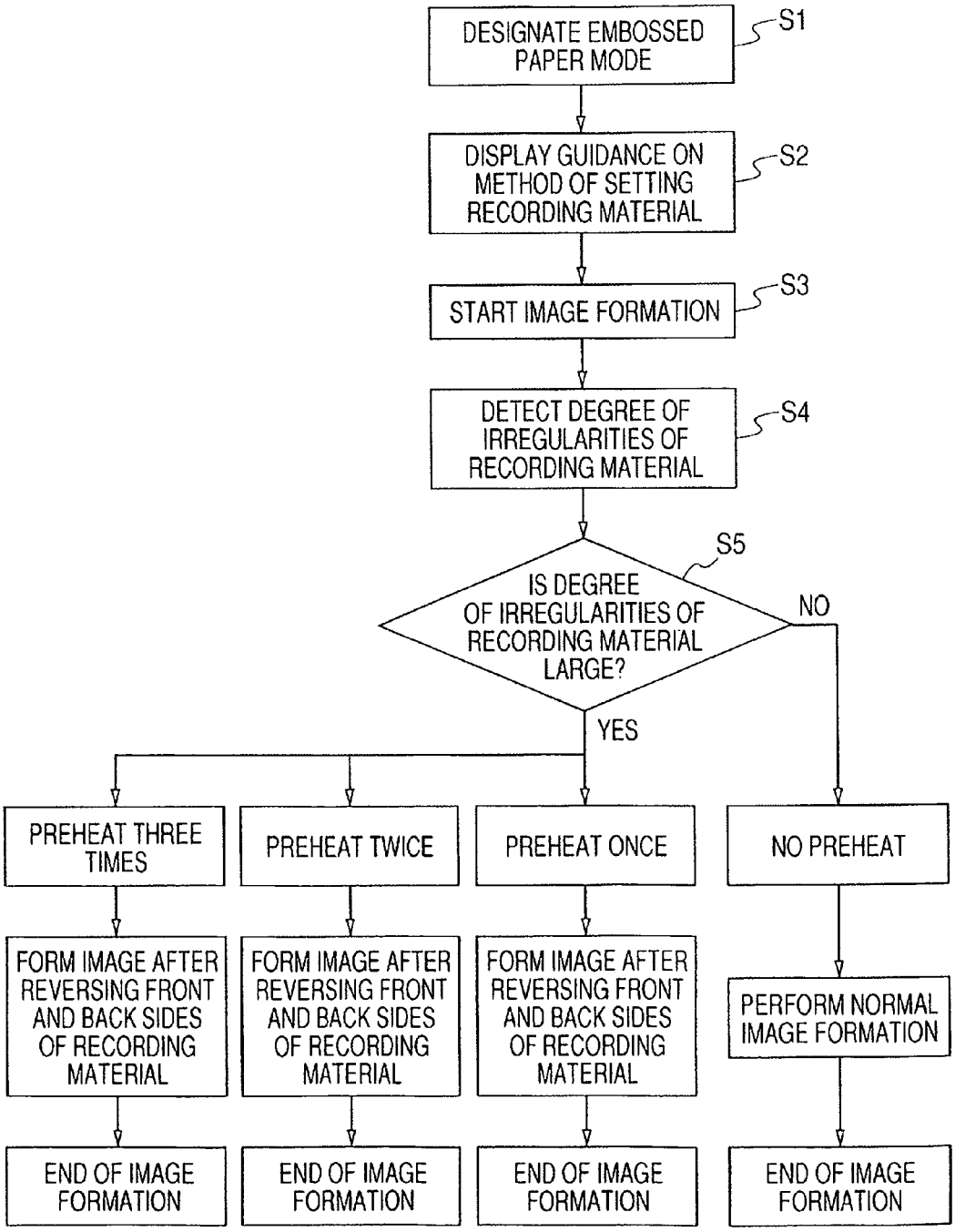
FIG. 13 is a flow chart showing an image forming sequence to embossed paper.

In such a construction, an operator first performs the designation of an "embossed paper" mode by the operating portion (see S1 in FIG. 13). Together with this mode designation, the start of image formation is designated (see S3 in FIG. 13), whereby the following step is executed. At that time, the operator set embossed paper in a sheet supplying cassette or a manually sheet feeding portion so that the image forming surface of the embossed paper which is formed with irregularities may face down, that is, the image forming surface of the embossed paper may contact with the pressure roller. At this time, with the designation of the embossed paper mode, display for calling upon the operator to set the embossed paper in the sheet supplying cassette or the manually sheet feeding portion so that the irregular surface of the embossed paper may face down is done on the operating portion (see S2 in FIG. 13).

First, without the toner being transferred onto the embossed paper S', or without a latent image being formed on the photosensitive member and without a toner image being formed on the embossed paper S', the irregular surface (image forming surface) of the embossed paper S' is brought into contact with the fixing roller 108 and a part of the pressure roller 109 which is greater in the deformation amount in the fixing nip N, and the embossed paper S' is passed through the fixing nip N while being heated ((i)-(ii) in FIG. 3A: the preheating step). That is, before image formation, the image forming surface is brought into contact with the pressure roller in the fixing nip to thereby subject the image forming surface to the preheating process.

The embossed paper S' passed through the fixing nip N has its front and back sides reversed while being conveyed on conveying routes such as a both-side path and a reversing path, and is again conveyed to the position before the transfer. Then, a toner image is formed on the irregular surface of the embossed paper S' by image forming means ((ii)-(iii) in FIG. 3A: the image forming step). The image forming means, although not particularly restricted if it is one for forming a toner image on the recording material, is comprised of a photosensitive drum on which an electrostatic latent image is formed, developing means for developing the electrostatic latent image with a toner, and transferring means for transferring the developed toner image to the recording material.

The embossed paper S' having a toner image formed on the irregular surface thereof is heated with its irregular surface on which the toner image has been formed brought into contact with the fixing roller 108 having therein a halogen heater as heat generating means and being small in the deformation amount in the fixing nip, and is passed through the fixing nip, whereby the toner image thereon is fixed ((iii)-(iv) in FIG. 3A: the fixing step).

The toner is fixed on the embossed paper S' passed through the fixing nip N, including the smooth surface and concave portions thereof, and the image is semipermanently held thereon. Design may be made such that in accordance with the kind of the recording material, the preheating process in the aforedescribed mode is repetitively executed a plurality of times. Thereby, fixing can also be effected on a recording material having a greater degree of irregularities.

Figure 3B:
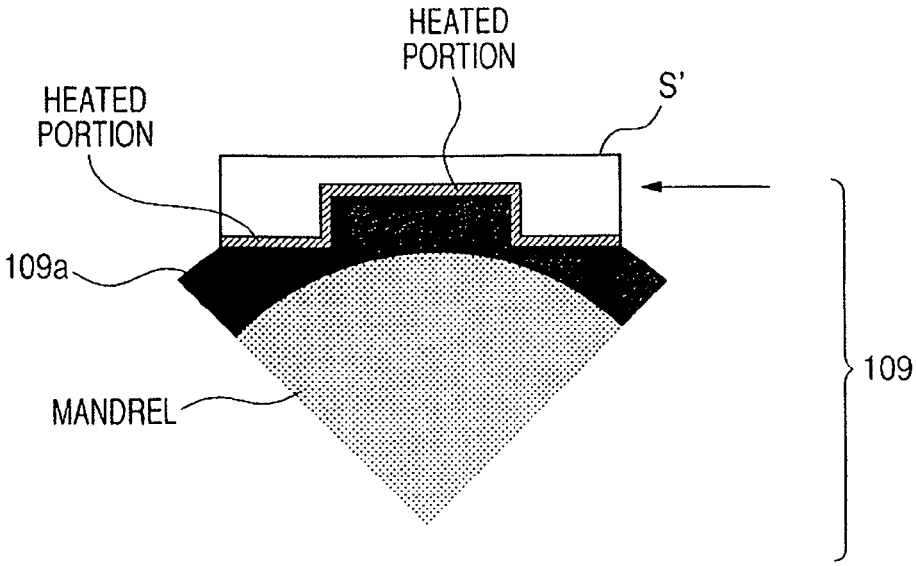

FIG. 3B is a typical view for illustrating an improvement in the fixability of the concave portion by the above-described means.

In (i), the embossed paper S' is passed without the image on its irregular surface being borne on the pressure roller 109 having an elastic layer 109*a* of a great thickness (5 mm in the present embodiment), whereby the heated portion widens over the entire concave portion with the elastic layer 109*a* being sufficiently brought into contact with or proximity to the wall of the concave portion. That is, when as in the present embodiment, the elastic layer 109*a* of the pressure roller 109 is thicker than the elastic layer of the fixing roller 108, the deformation amount of the pressure roller 109 in the fixing nip N becomes great and correspondingly, the elastic layer comes into the entire concave portion. As the result, the concave portions of the surface having irregularities can be heated more efficiently.

Also, by passing through the steps (i)→(iii), the heat accumulated in the concave portions of the embossed paper S' becomes an additional heat amount when fixing is effected with the toner borne on the embossed paper at the steps (iii)→(iv). As the result, the fixability of the concave portions of the embossed paper S' can be markedly improved (this fixing method will hereinafter be referred to as the preheating).

Thus, a both-side path or the like provided in the conventional image forming apparatus and having a mechanism for once returning the recording material to the position before transfer is higher in the effect of preheating. On the other hand, even if there is not the mechanism such as the both-side path for automatically returning the recording material to the position before transfer, it is also possible to achieve an improvement in fixability by installing such mechanism in a sheet feeding apparatus or a manually feeding apparatus so that preheated embossed paper once discharged out of the apparatus can be again passed with the embossed surface facing the fixing roller side, and causing the toner to be transferred to the embossed surface.

Such a fixing system by preheating can improve the fixability of the concave portions of the embossed paper without the provision of an additional heat source and the changing of the fixing member, and can reduce the offset due to poor fixing and the contamination or the like of the fixing device and the image forming apparatus, thus maintaining good image formation.

Embodiment 2

Figure 4:
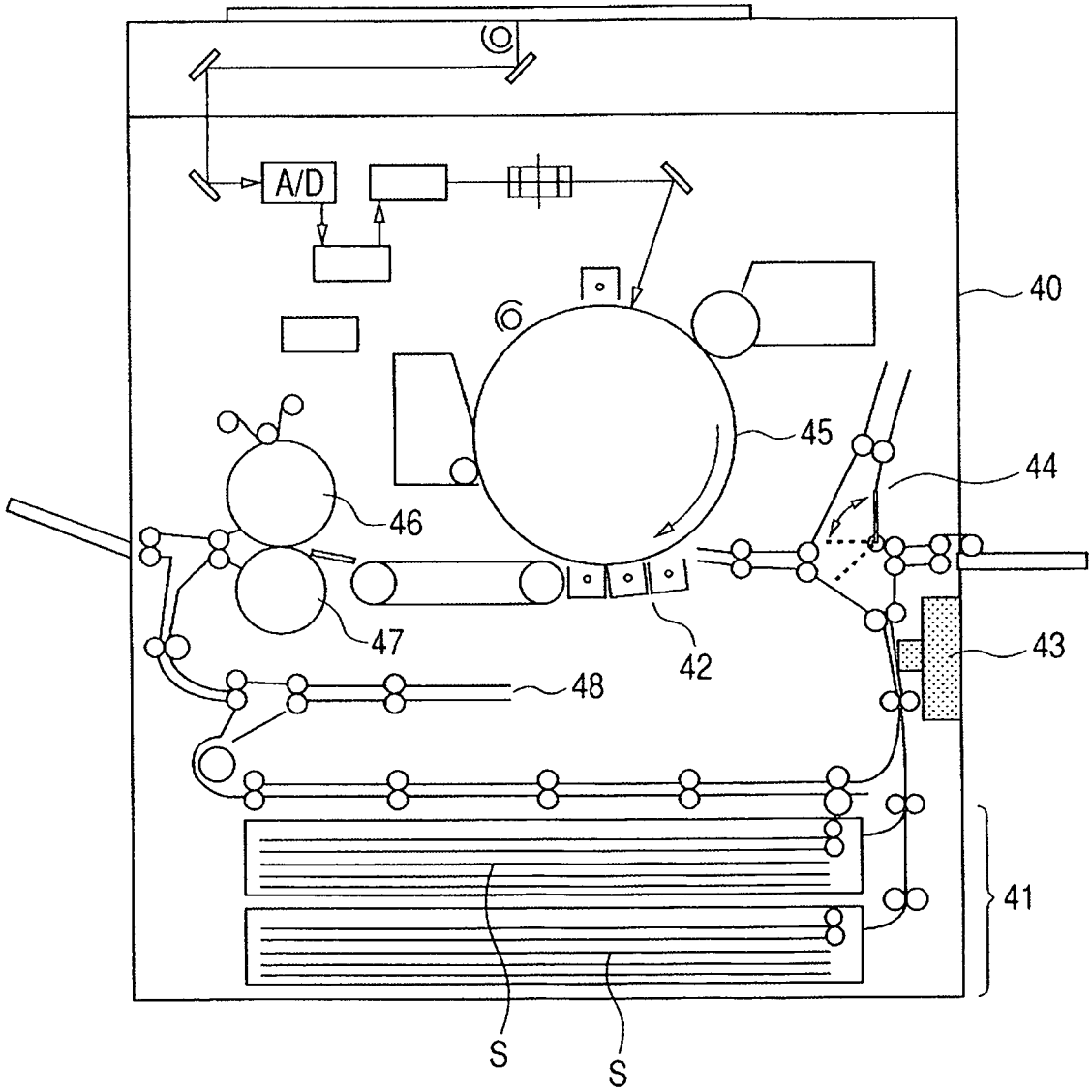
FIG. 4 is a cross-sectional view of an image forming apparatus according to Embodiment 2.

FIG. 4 is a cross-sectional view of an image forming apparatus according to Embodiment 2. This embodiment is characterized in that, unlike Embodiment 1, the embossed paper mode is not executed by the designation from the operating portion of the image forming apparatus, but whether the recording material is embossed paper is automatically discriminated, whereby the preheating step for embossed paper similar to that in Embodiment 1 is executed. The present embodiment will hereinafter be specifically described.

The image forming apparatus 40 shown in FIG. 4 has a media sensor 43 as detecting means capable of detecting the surface roughness, basis weight, thickness, etc. of a recording material S installed between a sheet feeding apparatus 41 and a transfer device 42. In the present embodiment, there can be adopted a media sensor using a piezoelectric element described, for example, in Japanese Patent Application Laid-open No. 2000-314618. Also, the media sensor 43 in the present embodiment may preferably be one which automatically measures the surface roughness, particularly the maximum roughness Rmax, of the recording material S. The media sensor 43 in the present embodiment is not restricted to this, but can be one which can measure information (index) according to the irregularities of the surface of the recording material.

Also, as a fixing member used in the present embodiment, there is adopted a thin-walled fixing roller 46 (elastic layer 100 μm) which is small in temperature reduction, and as a pressure member, there is adopted such a thick-walled pressure roller 47 (elastic layer of 5 mm) as will widen the fixing nip between it and the fixing member.

Also, an ante-transfer reversing path 44 which can automatically reverse the front and back sides of the recording material S is installed between the media sensor 43 and the transfer device 42.

When in such an image forming apparatus 40, embossed paper and plain paper as recording materials are mixedly present and are passed, the plain paper is conveyed from the sheet feeding apparatus 41 of FIG. 4 to the transfer device 42 as in normal image formation. Then, a toner image formed on a photosensitive member 45 is transferred onto the plain paper by the transfer device 42, and the plain paper having the toner image borne thereon is passed through the fixing nip N between a fixing roller 46 and a pressure roller 47, and the toner image is heat-fixed on the plain paper, whereby an image is formed thereon.

However, when the recording material S is embossed paper, if the paper is passed by control similar to that for the aforedescribed plain paper, the inconvenience of poor fixing will occur. Particularly when plural kinds of recording materials on which images are to be formed are mixedly present, it requires much trouble and time for a person operating the image forming apparatus to discriminate between plain paper and embossed paper.

So, in the present embodiment, when the media sensor 43 has judged the recording material S to be a recording material of which the image forming surface is embossed (see S4 and S5 in FIG. 13), the recording material is reversed by an ante-transfer reversing path 44 provided before the transferring position of the transfer device 42 so that the embossed surface thereof may face down, that is, the embossed surface may be turned toward the pressure roller 47, and a toner image is not formed on the photosensitive member 45, but the recording paper is made to pass the transfer device 42 and pass between the fixing roller 46 and the pressure roller 47. Thereafter, the embossed paper was reversed by the reversing path 48 of FIG. 4 so that the embossed surface thereof might face upward to the transfer device 42, that is, the embossed surface might be turned toward the fixing roller 46, and a toner image was formed on the photosensitive member 45, and the toner image was transferred onto the paper by the transfer device 42, and the paper was passed through the fixing nip between the fixing roller 46 and the pressure roller 47 to thereby fix the toner image on the paper.

By such a construction, even when various kinds of paper are mixedly present on the sheet feeding apparatus 41, only embossed paper can be preheated to thereby stably fix a toner image thereon. Also, the extra discrimination between the kinds of paper before the paper is installed is unnecessary, and good images can be formed on the respective kinds of paper.

Embodiment 3

FIG. 10 shows the maximum surface roughness Rmax of the embossed paper measured by the media sensor 43 in FIG. 4 and the fixability by the above-described preheating. In the present embodiment, there is shown the fixability on sheets of embossed paper having a thickness of 300 μm and Rmax of 100 μm, 150 μm and 200 μm, respectively, in a fixing device 106 of the construction of Embodiment 1. Also, measurement was effected about the cases where the frequency of preheating is 0 time, once, twice and three times. The fixability was judged by rubbing the groove portions (concave portions) after the embossed paper was discharged from the image forming apparatus, and stripping off the toner in the groove portions.

It has been found that as the frequency of preheating is increased as described above, the number of sheets of embossed paper which can be coped with increases. Thus, in the present embodiment, there is adopted a construction in which in accordance with the information of the degree of irregularities (Rmax) of the embossed paper measured by the media sensor 43 of FIG. 4, the frequency (0 time to three times) of the preheating step is controlled along a flow chart shown in FIG. 13.

If for example, Rmax is 150 μm, a toner image is not formed, but the preheating step at which the embossed paper is passed with its embossed surface brought into contact with the pressure roller 47 is executed twice (see FIG. 13), whereafter by the third paper passing, a toner image is formed on the embossed surface and also, this toner image is brought into contact with the fixing roller 46 to thereby fix the toner image.

By adopting such a construction, it is possible to cope with a wide range of kinds of embossed paper, and even if various kinds of embossed paper are mixedly set in the sheet feeding portion, effective frequency of preheating is automatically selected and good images can be formed on the respective kinds of embossed paper.

Embodiment 4

As regards the fixing device, when the image forming operation is started from a standby state and the fixing roller begins to be rotated, heat is taken away from the fixing roller to the pressure roller because usually the pressure roller is not provided with an exclusive heat source, and much time is taken until the surface of the fixing roller again reaches a normal sheet passing controlled temperature. The rotation until then is called pre-rotation.

In the present embodiment, the rotation time of the fixing roller and the pressure roller from after an image formation starting signal has been inputted until image formation is started in a case where an image is to be formed on embossed paper is made longer than in a case where an image is to be formed on other paper, e.g. plain paper, than embossed paper.

That is, in a case where an image was to be formed on embossed paper, in addition to the ordinary pre-rotation, the rotation time of the fixing roller and the pressure roller was further given, and heat was applied to the pressure roller (this will hereinafter be referred to as the pre-multi-rotation), whereafter the paper passing to the fixing nip was effected. FIG. 11 shows the fixability when the fixing device 106 of Embodiment 1 was used, and the controlled temperature of the fixing roller was 200 degrees, and the frequency of preheating on sheets of embossed paper having a thickness of 300 μm and Rmax of 100 μm, 125 μm, 150 μm and 175 μm, respectively was once. The fixability was judged by rubbing the groove portions (concave portions) after the embossed paper was discharged from the image forming apparatus, and stripping off the toner in the groove portions.

It has been found that as the pre-multi-rotation time is longer as described above, the number of sheets of embossed paper which can be coped with increases. From this, in the present embodiment, there is adopted a construction in which by Rmax which is one piece of information about the irregularities of the embossed paper measured by the media sensor 43 shown in FIG. 4, feedback is automatically effected to the pre-multi-rotation time. For example, design is made such that if Rmax is 150 μm, pre-multi-rotation is effected for 20 sec. in addition to pre-rotation, and then the preheating mode is entered. By adopting such a construction, it is possible to cope with a wider range of kinds of embossed paper, and even if various kinds of embossed paper are mixedly set in the sheet feeding portion, effective frequency of preheating is automatically selected and good images can be formed on the respective sheets of embossed paper.

Embodiment 5

In the present embodiment, in a case where an image is to be formed on embossed paper, the controlled temperature during the pre-multi-rotation in Embodiment 4 was made higher than the controlled temperature in a case where an image is to be formed on other paper, e.g. plain paper, than embossed paper.

Specifically, in the present embodiment, in contrast with a sheet passing controlled temperature of 200 degrees, the controlled temperature during pre-multi-rotation was set to 210 degrees. FIG. 12 shows the fixability in a case where the fixing device of Embodiment 1 was used, and the frequency of preheating on sheets of embossed paper having a thickness of 300 μm and Rmax of 100 μm, 125 μm, 150 μm and 175 μm, respectively, was once. The fixability was judged by rubbing the groove portions (concave portions) after the embossed paper was discharged from the image forming apparatus, and stripping off the toner in the groove portions.

By setting the controlled temperature during the pre-multi-rotation higher than the controlled temperature during the ordinary sheet passing, as described above, it is possible to shorten the pre-multi-rotation time for fixing the image on the embossed paper of the same Rmax, as compared with Embodiment 4. Accordingly, preheating can be performed efficiently and a good image can be formed on the embossed paper.

Embodiment 6

Figure 5:
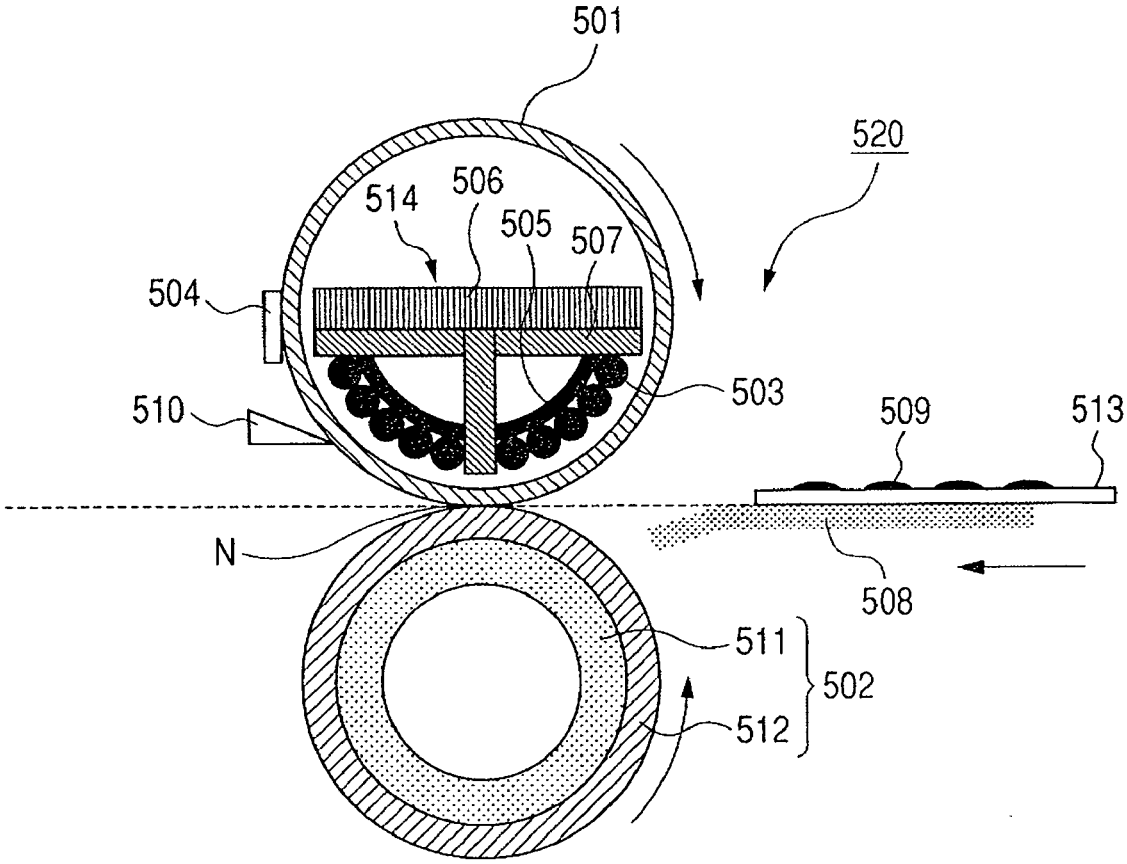
FIG. 5 is a cross-sectional view of a fixing device according to Embodiment 6 using an electrically conductive material generating heat by an induced current.

FIG. 5 is a cross-sectional view of a fixing device using an electrically conductive material generating heat by an induced current. The reference numeral 501 designates a fixing roller as a heating member, and the reference numeral 502 denotes a pressure roller as a pressure member.

The fixing roller 501 is formed of an electrically conductive material generating heat by an induced current. In the present embodiment, the fixing roller 501 has a mandrel cylinders (electrically conductive cylindrical roller) made of iron having an outer diameter of 40 mm and a thickness of 0.7 mm as a base member, and may be provided with a surface toner releasing layer having a thickness of 10 to 50 μm formed of, for example, PTFE or PFA in order to enhance the toner releasing ability of the surface thereof. Also, in order to improve the fixability and reduced the temperature unevenness of the surface of the roller, an elastic layer having a thickness of 20 to 500 μm formed of, for example, silicone rubber may be provided between the iron mandrel cylinder and the surface toner releasing layer.

The pressure roller 502 comprises a hollow mandrel 511 and an elastic layer 512 which is a surface toner releasable heat-resisting rubber layer formed on the outer peripheral surface thereof or a sponge layer being also adiabatic between the hollow mandrel 511 and the surface. The thickness of the elastic layer is 5 mm. The elastic layer may desirably have a thickness of 1 mm to 10 mm in order to widen the fixing nip to thereby enhance the fixability.

The fixing roller 501 and the pressure 502 are disposed so as to be opposed and parallel to each other with the fixing roller 501 overlying the pressure roller 502. The opposite end portions of each roller are rotatably mounted between fixing unit frames (not shown) through bearing portions.

The pressure roller 502 is biased toward the rotary shaft of the fixing roller 501 by a pressure mechanism (not shown) using a spring or the like, and is brought into pressure contact with the underside portion of the fixing roller 501 with a predetermined pressure force to thereby form a fixing nip (pressure contact nip) N. In the present embodiment, the pressure roller 502 is loaded with about 294 N (Newton) (about 30 kgf (kilogram-force)). In that case, the width (nip width) of the fixing nip N is about 6 mm. In some cases, however, the load may be changed to thereby change the nip width.

In the present embodiment, the fixing roller 501 is designed to be rotatively driven by a driving mechanism (not shown) and the pressure roller 502 is driven to rotate by a frictional force in the fixing nip N with this rotative driving of the fixing roller 501.

An induction coil assembly 514 is inserted and disposed in the internal space of the fixing roller 501, and comprises an induction coil 503, a coil holder 505, a core (magnetic core) 507 which is a magnetic member, a stay 506, etc.

The coil holder 505 is a trough-shaped member having a substantially semicircular transverse cross-sectional shape formed of heat-resistant resin such as PPS, PEEK or phenol resin, and the induction coil 503 having a conductor wound thereon is provided around this coil holder 505. The core 507 is provided inside the coil holder 505 so that the transverse cross section thereof may assume a T-shape. The whole of the induction coil 503, the coil holder 505, the core 507 and the stay 506 may be tightly covered, for example, with a thermally contractive tube and thereby be made into a unit as an induction coil assembly.

The above-described induction coil assembly 514 is inserted into the internal space of the fixing roller 501 and is brought into a state proximate to the inner surface of the fixing roller 501 with the induction coil 503 outside the coil holder 505 turned downwardly. Then, the opposite end portions of the stay 506 is fixedly supported between the fixing unit frames (not shown) to thereby dispose the induction coil assembly 514 in the internal space of the fixing roller 501.

A temperature sensor 504 is a thermistor disposed so as to contact with the surface of the fixing roller 501. A separating pawl 510 is disposed in contact with or proximity to the surface of the fixing roller 501 on the recording material exit side of the fixing nip N.

In the fixing device 520 of the above-described construction, in a state in which the fixing roller 501 is rotatively driven and the pressure roller 502 is driven to rotate, an alternating current of a high frequency is applied from an excitation circuit to the induction coil 503. The excitation circuit is designed to generate a high-frequency wave of 10 kHz to 100 kHz by a switching power source. The induction coil 503 generates an alternating magnetic flux by an alternating current of a high frequency supplied from this excitation circuit. A magnetic field induced by the alternating current causes an eddy current to flow to the inner surface of the fixing roller 501 which is an electrically conductive layer to thereby generate Joule heat, and the fixing roller 501 is efficiently and quickly heated and rises in temperature.

If the frequency of the high-frequency wave is smaller than 10 kHz, it overlaps the human audio region, and a sound is produced. If it is greater than 100 kHz, the loss due to the power source becomes great. Therefore, a high-frequency wave of 10 kHz to 100 kHz is preferable.

The temperature of the fixing roller 501 is detected by the temperature sensor 504, and the detected temperature signal thereof is inputted to a control circuit. The control circuit controls the supply of electric power from the excitation circuit to the induction coil 503 on the basis of the detected temperature signal inputted thereto, and automatically controls the surface temperature of the fixing roller 501 so as to be maintained at a predetermined constant temperature (predetermined fixing temperature).

In a state in which the surface temperature of the fixing roller 501 is automatically controlled to the predetermined constant temperature, a recording material 513 bearing an unfixed toner image 509 thereon is introduced into the fixing nip N by a conveying guide 508 and is nipped and conveyed thereby, whereby the unfixed toner image 509 is heated and fixed on the surface of the recording material 513 by the heat of the fixing roller 501.

In such a fixing device, the fixing roller 501 is used to select an electrically conductive material generating heat by an induced current, i.e., a metallic substance like iron in the present embodiment. Also, even if an elastic layer is provided as the surface layer of the fixing roller 501 in order to widen the fixing nip N, it is necessary to make the fixing roller thin-walled in order to make the heat conductivity from the mandrel good. Also, in order to widen the fixing nip, a correspondingly thick elastic layer is provided on the pressure roller 502. Therefore, the pressure roller becomes greater in the deformation amount in the fixing nip.

In this fixing device 520, when a toner image is transferred to embossed paper having its surface embossed, and the embossed paper is passed through the fixing nip N, heat is transmitted to the toner on the smooth portions of the paper and the toner is fixed on the paper. However, the toner in the embossed concave portions (groove portions) causes poor fixing, and is offset on the fixing roller 501 or is stripped off from the paper, whereby it is conceivable that the fixing device and the interior of the image forming apparatus are contaminated.

In the present embodiment, the fixability of embossed paper was improved by adopting the preheating method described in Embodiment 1. For example, the embossed paper is passed with its embossed surface (surface having irregularities) turned in a direction to contact with the pressure roller 502, namely, downwardly, and is passed through the fixing nip N without a toner image being transferred thereto. Thereafter, the embossed paper is returned to the position before transfer through a both-side path (not shown) or the like, and is passed with its embossed surface turned in a direction to contact with the fixing roller 501, namely, upwardly, and a toner image is transferred to the embossed surface, and the embossed paper is passed through the fixing nip N to thereby permanently fix the toner image on the embossed paper.

By such a construction, even in the case of a fixing roller using an electrically conductive material generating heat by an induced current, the fixability of the groove portions of the embossed paper could be improved without the provision of an additional heat source and the changing of the fixing member, and the offset due to poor fixing and the contamination of the fixing device and the image forming apparatus could be mitigated to thereby form good images.

Embodiment 7

Figure 6:
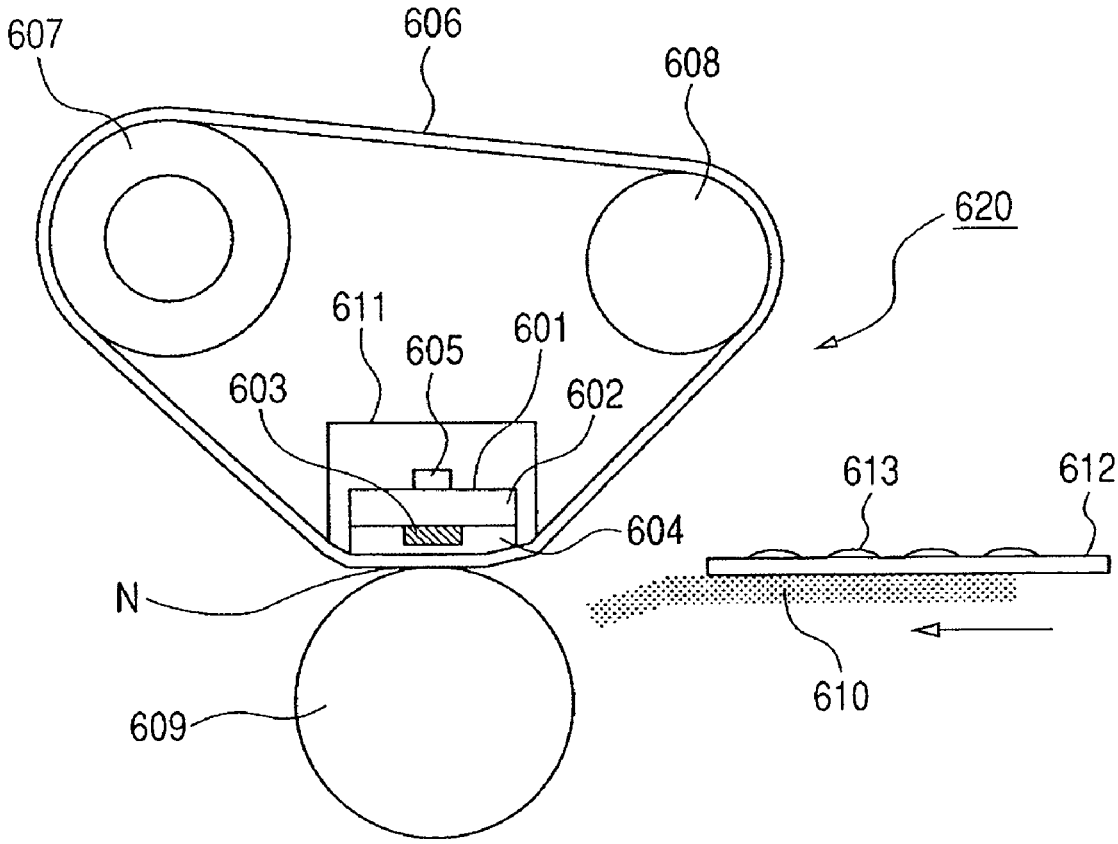
FIG. 6 is a cross-sectional view of a fixing device according to Embodiment 7 using fixing film and a non-elastic heating member.

FIG. 6 is a cross-sectional view of a fixing device using fixing film and a non-elastic heating member according to Embodiment 7. The fixing film 606 is an endless belt comprised of thin heat-resistant film. Also, the fixing film 606 is stretched around a left drive roller 607, a right driven roller 608 and a linear heater 601 of low heat capacity fixedly disposed between and below the two rollers 607 and 608.

The driven roller 608 serves also as a tension roller for giving tension in a direction to extend the fixing film 606 outwardly. Also, when the drive roller 607 having its surface covered with silicone rubber or the like to thereby enhance the coefficient of friction thereof is rotatively driven in a clockwise direction, the fixing film 606 is rotatively driven in the clockwise direction at a predetermined peripheral speed without wrinkling or meandering and without any delay in speed.

A pressure roller 609 as pressurizing means has an elastic rubber layer of high toner releasing ability such as silicone rubber, and the longitudinal length and diameter thereof are set to 350 mm and 25 mm, respectively, and the thickness of the elastic rubber layer is set to 5 mm. The rubber layer may desirably have a thickness of 1 mm to 10 mm in order to widen the fixing nip and enhance the fixability.

This pressure roller 609 is opposed to and brought into pressure contact with the underside of the heater 601 with a contact force of e.g. 49 to 98 N (5 to 10 kgf) by biasing means such as a spring with the lower side portion of the fixing film nipped between the pressure roller and the heater 601, and is rotated in the same counter-clockwise direction as the conveying direction of a recording material 612.

The rotatively driven fixing film 606 is repetitively used for the heating and fixing of a toner image and therefore, as the fixing film 606, use is made of thin heat-resistant film of generally 100 μm or less, and preferably 40 μm or less excellent in heat resistance, toner releasing ability and durability. As an example, use is made of an endless belt having a total thickness of 30 μm comprising a thin endless belt of highly heat-resistant resin such as polyimide, polyetherimide, polyethersulfone, polyether or etherketone, or a metal such as nickel or SUS having a thickness of 20 μm, and resin of low surface energy such as PTFE (tetrafluoroethylene resin) or PFA (tetrafluoroethylene perfluoroalkyl vinyl ether copolymer resin) or a toner releasing coat layer consisting of an electrically conductive material such as carbon black added to these resins, and formed to a thickness of 10 μm on the outer peripheral surface of the thin endless belt.

Also, the heater 601 is formed with a heat generating layer 603 comprising, for example, an alumina substrate 602 having a thickness of 1.0 mm, a width of 10 mm and a longitudinal length of 340 mm, and coated with a resistance material such as silver palladium or ruthenium oxide to a thickness of 10 μm and a width of 1.0 mm. It is constituted by a protective layer 604 of glass or the like having a thickness of 10 μm being formed on the heat generating layer 603 with the sliding relative to the fixing film 606 taken into account, and is attached to and fixedly supported on a heater supporting member 611.

The heater supporting member 611 is formed of a material excellent in adiabatic property, heat resistance and rigidity for adiabatically supporting the heater 601 relative to the fixing device 620 and the image forming apparatus, for example, highly heat-resistant resin such as PPS (polyphenylene sulfide), PEEK (polyether etherketone) or a liquid crystal polymer, or a compound material consisting of these resins and ceramics, a metal or the like.

The heat generating layer 603 of the heater 601 is electrically energized from its longitudinally opposite ends. The electrical energization is done by an AC voltage of 100 V, and is controlled by an MPU (not shown) in accordance with the detected temperature by a thermistor 605 such as an NTC thermistor adhesively secured to the back of the alumina substrate 602 by a thermally conductive silicone rubber adhesive agent or the like or brought into pressure contact with or formed integrally with the alumina substrate 602.

In a state in which the heater 601 is automatically controlled to a constant temperature by the thermistor 605, the recording material 612 bearing an unfixed toner image 613 is introduced into the fixing nip N by a conveying guide 610 and is nipped and conveyed, whereby the unfixed toner image 613 is heated and fixed on the surface of the recording material 612.

In the fixing device 620 according to the present embodiment, thin film is adopted as the fixing film 606 in order to enhance the thermal conductivity from the heater 601, as described above. Also, the heater 601, the heater supporting member 611 and the protective layer 604 are formed of a non-elastic material, and as compared with the pressure roller 609, only the thin film is an elastic layer, and the total hardness of the heater and the film is set high as compared with the pressure roller 609. In the present embodiment, the total hardness of the heater and the film is 30 degrees, and the hardness of the pressure roller 609 is 70 degrees (Asker C hardness meter). That is, in the present embodiment, if the hardness of the heater 601 and the fixing film 606 is higher than the hardness of the pressure roller 609, the deformation amount of the pressure roller 609 in the fixing nip N becomes great and correspondingly, the elastic layer goes into the entire concave portion.

When in the fixing device 620, the toner image is transferred to embossed paper having its surface embossed, and the embossed paper is passed through the fixing nip N, heat is transmitted to the toner on the smooth portions of the paper and the toner image is fixed on the paper, but the toner in the embossed concave portions (groove portions) causes poor fixing, and it is conceivable that the toner is offset on the fixing film 606 or the toner is stripped off from the paper, to thereby contaminate the fixing device and the interior of the image forming apparatus.

In the present embodiment, the preheating method described in Embodiment 1 was adopted to thereby improve the fixability of the embossed paper. For example, the embossed paper is passed with its embossed surface turned in a direction to contact with the pressure roller 609, namely, downwardly, and is passed through the fixing nip N without the toner image being transferred thereto. Thereafter, the embossed paper is returned to the position before transfer through a both-side path (not shown) or the like, and is passed with its embossed surface turned in a direction to contact with the fixing film 606, namely, upwardly, and the toner image is transferred to the embossed surface, and the embossed paper is passed through the fixing nip N to thereby fix the toner image on the embossed paper.

Even in a fixing device adopting a quickly rising on-demand fixing member like a construction using the fixing film and the non-elastic heating member, as described above, the fixability of the concave portions (groove portions) of the embossed paper can be improved without the provision of an additional heat source and the changing of the fixing member, and the offset due to poor fixing and the contamination of the fixing device and the image forming apparatus can be mitigated, and good images can be formed.

Embodiment 8

Figure 7:
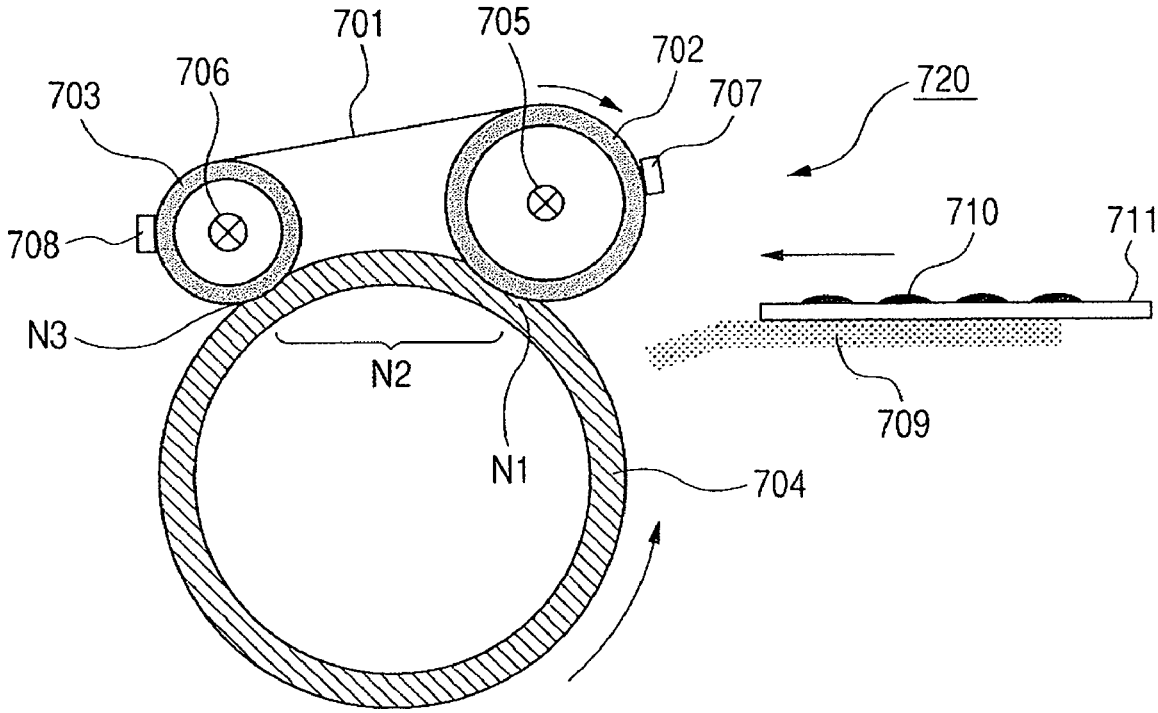
FIG. 7 is a cross-sectional illustration showing a fixing device according to Embodiment 8 using a fixing belt.
Figure 8:
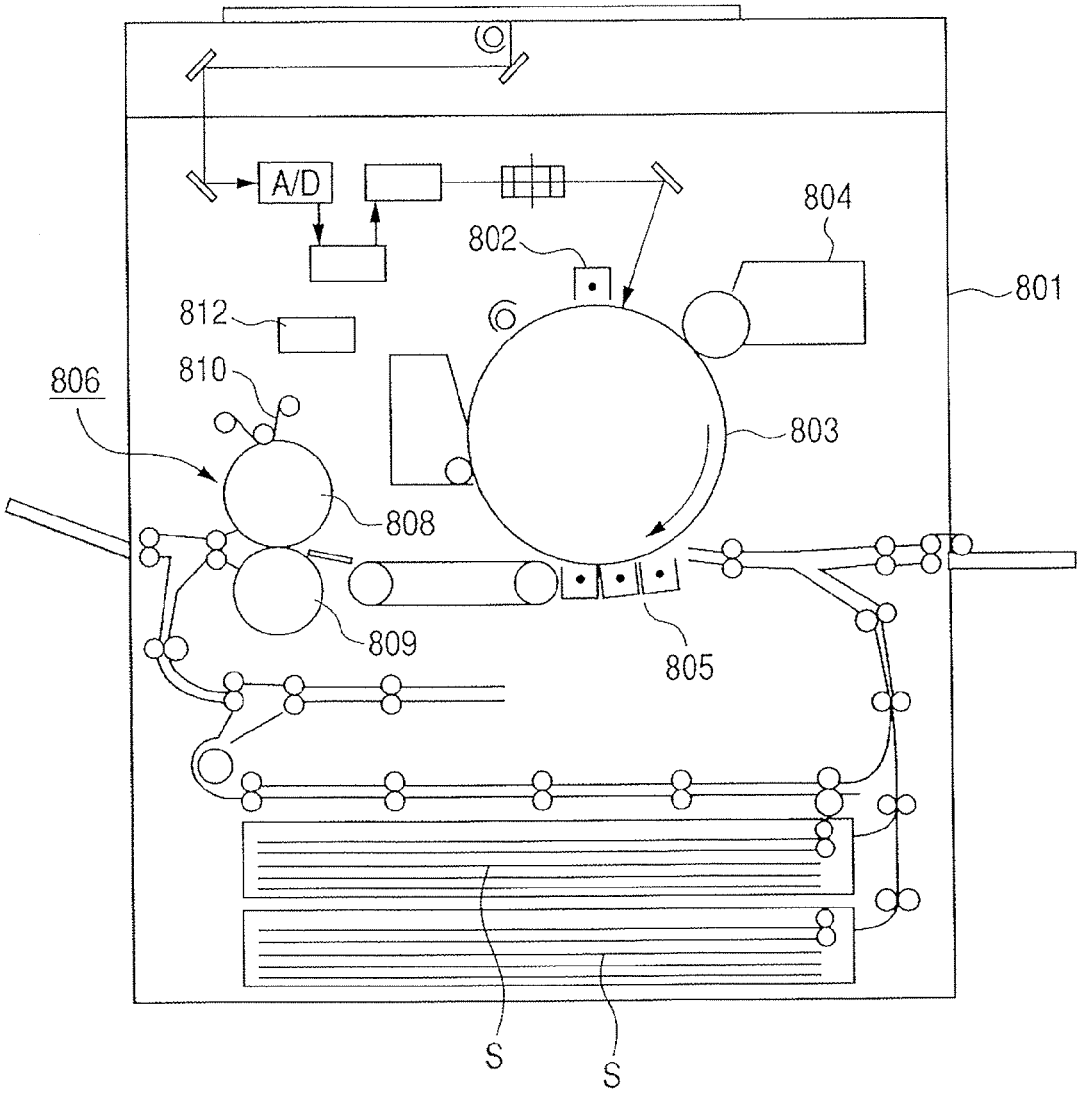
FIG. 8 PRIOR ART
FIG. 8 is a cross-sectional view showing an example of the construction of a conventional image forming apparatus.
Figure 9:
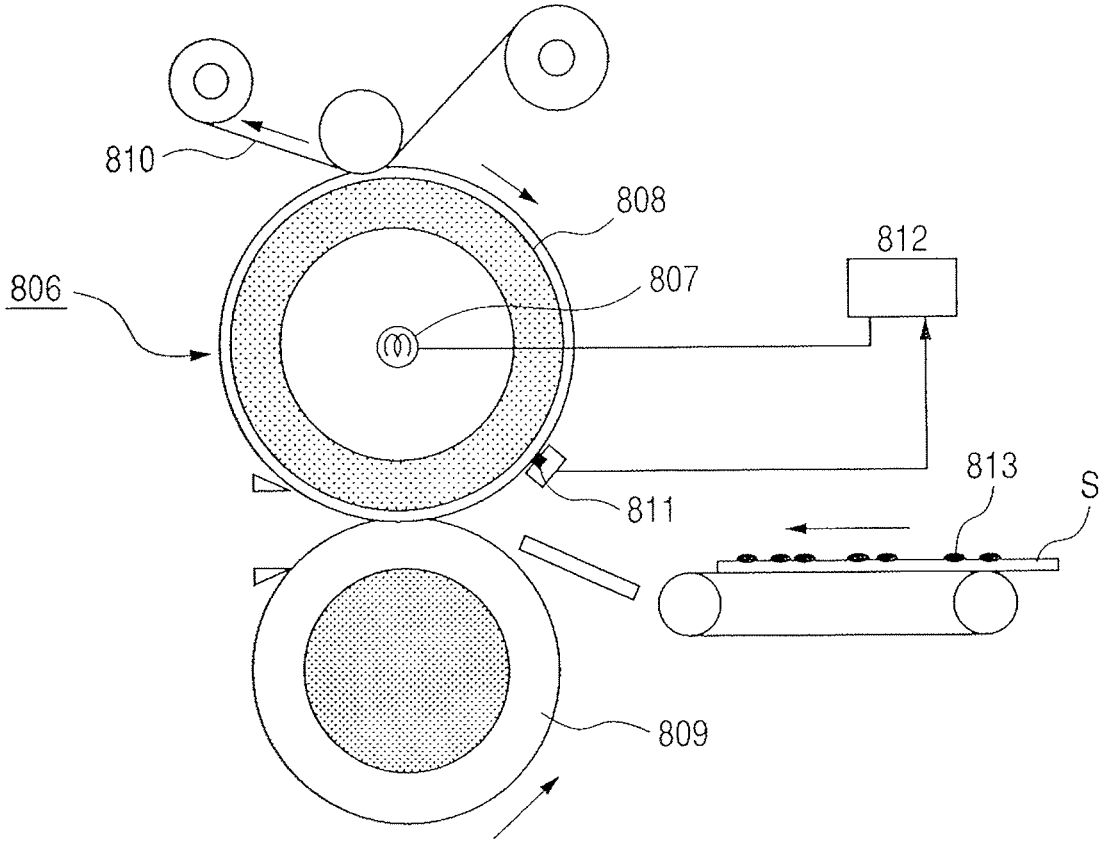
FIG. 9 PRIOR ART
FIG. 9 is a cross-sectional view showing an example of the construction of the surroundings of a conventional fixing device.

FIG. 7 is a cross-sectional view of a fixing device using a belt, a fixing roller and a pressure roller according to Embodiment 8.

A fixing belt 701 is ϕ30 mm, and the base member thereof is made of Ni by electroforming, and the thickness thereof is 30 to 100 μm. Further, an elastic layer of 100 to 300 μm is provided on the outer periphery of the base member made of Ni, and a layer of fluorine resin such as PFA or PTFE as a toner releasing layer is provided to a thickness of 10 to 100 μm (preferably 20 to 60 μm) on the outer periphery of the elastic layer.

A fixing belt winding roller 702 is a sleeve of ϕ20 mm made of Al, and the wall thickness thereof is 4 mm. A fixing belt winding roller 703 is a sleeve of ϕ15 mm made of Al, and the wall thickness thereof is 1.5 mm.

A pressure roller 704 is ϕ50 mm and the base member thereof is a sleeve made of iron and having a thickness of 1 mm, and a silicone rubber sponge having a thickness of 3 mm as an elastic layer is provided on the outer periphery of the base member, and a PFA tube having a thickness of 50 μm as a toner releasing layer is provided on the surface layer of the elastic layer. The silicone rubber sponge layer may desirably have a thickness of 1 mm to 10 mm in order to widen the fixing nip and enhance the fixability.

The fixing belt winding roller 702 and the fixing belt winding roller 703 are urged against the pressure roller 704 with total pressure of 98 N (10 kgf) and total pressure of 147 N (15 kgf), respectively. Also, the fixing belt winding roller 702 and the fixing belt winding roller 703 are driven so that the rotation speed of the fixing belt 701 may be 170 mm/sec., and the pressure roller 704 is driven to rotate thereby. Alternatively, the pressure roller 704 may also be driven.

In the present embodiment, the width of the nip formed by the fixing belt 701 and the pressure roller 704 is about 20 mm.

Halogen lamp heaters 705 and 706 as heating sources are disposed in the fixing belt winding roller 702 and the fixing belt winding roller 703, respectively. The halogen lamp heaters 705 and 706 have rated electric power of 350 W and rated electric power of 150 W, respectively, and are ON/OFF-controlled so as to assume 200 degrees which is a target temperature, on the basis of temperatures detected by temperature sensors 707 and 708.

A conveying guide 709 is disposed at a position for guiding a recording material 711 conveyed while bearing an unfixed toner image 710 thereon to the nips N1→N2→N3 between the fixing belt 701 and the pressure roller 704 in the named order.

As described above, the places where the unfixed toner image 710 is fixed are the fixing nips N1, N2 and N3. The toner is fused in the fixing nips N1 and N3 chiefly by the pressure and heat of the pressure roller 704 to the fixing belt winding rollers 702, 703 and the fixing belt 701, and in the fixing nip N2 chiefly by the heat of the pressure roller 704 to the fixing belt 701.

In the present embodiment, the elastic layer of the fixing belt 701 is made thin relative to the pressure roller 704 in order to make the thermal conductivity from the heaters good. Also, the total hardness of the winding rollers 702, 703 and the fixing belt 701 is made lower than the hardness of the pressure roller 704. In the present embodiment, the total hardness of the winding rollers 702, 703 and the fixing belt 701 is 45 degrees, where the hardness of the pressure roller 704 is 70 degrees (Asker C hardness meter).

In the fixing device 720 according to the present embodiment, when the toner image is transferred to embossed paper having its surface embossed and the embossed paper is passed through the fixing nips N, heat is transmitted to the toner on the smooth surface portions of the paper and the toner is fixed, but it is conceivable that the toner in the embossed concave portions (groove portions) causes poor fixing, and is offset on the fixing belt 701 or the toner is stripped off from the paper to thereby contaminate the fixing device and the interior of the image forming apparatus.

In the present embodiment, the preheating method described in Embodiment 1 was adopted to thereby improve the fixability of the embossed paper. For example, the embossed paper was passed with its embossed surface turned in a direction to contact with the pressure roller 704, namely, downwardly, and was passed through the fixing nips without the toner image being transferred thereto. Thereafter, the embossed paper is returned to the position before transfer through a both-side path (not shown) or the like, and is passed with its embossed surface turned in a direction to contact with the fixing belt 701, namely, upwardly, and the toner image is transferred to the embossed surface, and the embossed paper is passed through the fixing nips N to thereby fix the toner image on the embossed paper.

As described above, even in a fixing device adopting a fixing member having wide fixing nips, like a fixing belt, it is possible to improve the fixability of the concave portions (groove portions) of embossed paper without the provision of an additional heat source and the changing of the fixing member, mitigate the offset due to poor fixing, and the contamination of the fixing device and the image forming apparatus, and form good images.

OTHER EMBODIMENTS (1) The present invention can also be applied to other fixing methods than the above-described fixing methods.

(2) By combining Embodiments 2 to 5 together, it is apparent to obtain an improvement in the fixability of a recording material such as embossed paper having irregularities on the surface thereof. It is also easy to apply this to the fixing devices of Embodiments 6 to 8.

(3) The toner may be powder or liquid.

(4) The toner developing method and means for the electrostatic latent image are arbitrary. They may be of a reversal developing type or a regular developing type. Generally, the developing method for the electrostatic latent image is classified roughly into four kinds, i.e., a method of coating a developer carrying and conveying member such as a sleeve with a nonmagnetic toner by a blade or the like, or coating the developer carrying and conveying member with a magnetic toner by a magnetic force, conveying the toner and applying it to an image bearing member in a non-contact state to thereby develop an electrostatic latent image (mono-component non-contact development), a method of applying the toner coating the developer carrying and conveying member as described above to the image bearing member in a contact state to thereby develop the electrostatic latent image (mono-component contact development), a method of using a mixture of toner particles and a magnetic carrier as a developer (dual component developer), conveying it by a magnetic force and applying it to the image bearing member in a contact state to thereby develop the electrostatic latent image (dual component contact development), and a method of applying the above-mentioned dual component developer to the image bearing member in a non-contact state to thereby develop the electrostatic latent image (dual component non-contact development).

(5) The transferring means may be of a blade transfer type, a belt transfer type or other contact transfer charging type, or a non-contact transfer charging type using a corona charger.

(6) The present invention can also be applied to an image forming apparatus using a method of directly transferring a toner to a recording material, or an intermediate transfer member such as a transfer drum or a transfer belt to effect not only monochromatic image formation, but form a multi-color or full-color image by multiplex transfer or the like.

(7) In the present embodiment, the media sensor measured the surface roughness, but can also measure such parameters as the thickness, basis weight, moisture amount and degree of smoothness of media. Also, in the above-described embodiments, description has been made chiefly of a media sensor of a type using a piezoelectric element, but other media sensor such as a reflection type and optical type sensor including a light emitting element and a light receiving element is also applicable.

The present invention is not restricted to the constructions of the above-described embodiments, but of course, they can be applied by being combined together as far as possible.

This application claims priority from Japanese Patent Application No. 2005-134116 filed on May 2, 2005, which is hereby incorporated by reference herein.

What is claimed is:

1. An image forming apparatus comprising:

an image forming device configured to form a toner image on a sheet;

a fixing member and a pressing member configured to fix the toner image on the sheet at a fixing nip therebetween, a hardness of said pressing member being smaller than a hardness of said fixing member;

a controlling device configured to operate in a preheating mode in which the sheet is preheated by inserting the sheet into the fixing nip before the toner image is formed on an image forming surface of the sheet; and a detector configured to detect a roughness of the image forming surface of the sheet, wherein said controlling device is operable in the preheating mode so that the image forming surface of the sheet is brought into contact with said pressing member based on an output of said detector.

2. An apparatus according to claim 1, further comprising a reversing device configured to reverse a front side and a back side of the sheet which is preheated in the preheating mode and a conveying device configured to convey the sheet, which is preheated and reversed in the preheating mode, toward said image forming device to form the toner image on the image forming surface of the sheet.

3. An apparatus according to claim 1, wherein said controlling device controls a number of a preheating operation based on the output of said detector.

4. An apparatus according to claim 3, wherein in the preheating mode, the preheating operation can be repetitively executed without reversing the sheet by said reversing device.

5. An image forming apparatus comprising:

an image forming device configured to form a toner image on a sheet;

a fixing member and a pressing member configured to fix the toner image on the sheet at a fixing nip therebetween, a hardness of said pressing member being smaller than a hardness of said fixing member;

a controlling device configured to operate in a preheating mode in which the sheet is preheated by inserting the sheet into the fixing nip;

a reversing device configured to reverse a front side and a back side of the sheet which is preheated in the preheating mode; and a conveying device configured to convey the sheet, which is preheated and reversed in the preheating mode, toward said image forming device to form the toner image on an image forming surface of the sheet, wherein when the sheet is provided with the image forming surface in which a value obtained by multiplying Rmax (μm) by Sm(μm) is $15\times10^3$ ($\mu m^2$) or greater, said controlling device is operable in the preheating mode so that the image forming surface of the sheet is brought into contact with said pressing member, where Rmax is a maximum height of roughness of the image forming surface, Sm is a mean spacing between peaks of the roughness of the image forming surface.

6. An apparatus according to claim 5, further comprising an informing device configured to inform of a method of setting whether the image forming surface faces upward or downward on a sheet setting portion so that the image forming surface of the sheet is brought into contact with said pressing member.

* * * * *

UNITED STATES PATENT AND TRADEMARK OFFICE

CERTIFICATE OF CORRECTION

PATENT NO. : 7,392,010 B2
APPLICATION NO. : 11/411070
DATED : June 24, 2008
INVENTOR(S) : Shibuya It is certified that error appears in the above-identified patent and that said Letters Patent is hereby corrected as shown below:

COLUMN 2:
Line 29, “remove” should read --removed--.
Line 37, “having a” should read --having--.

COLUMN 4:
Line 43, “parameters” should read --parameter--.

COLUMN 5:
Line 41, “comprises” should read --is comprised--.

COLUMN 9:
Line 64, “paper,” should read --paper, rather--.

Signed and Sealed this

Sixteenth Day of December, 2008

JON W. DUDAS
*Director of the United States Patent and Trademark Office*